US009821364B2

(12) United States Patent
Byon et al.

(10) Patent No.: US 9,821,364 B2
(45) Date of Patent: Nov. 21, 2017

(54) DOUBLE PIPE TYPE HEAT EXCHANGER AND METHOD FOR MANUFACTURING THE SAME

(71) Applicant: Halla Visteon Climate Control Corp., Daedeok-gu, Daejeon (KR)

(72) Inventors: Sang Chul Byon, Daejeon (KR); Yong Ho Kim, Daejeon (KR); Dae Keun Park, Daejeon (KR); Nam Joon Lee, Daejeon (KR)

(73) Assignee: Hanon Systems, Daedeok-Gu, Daejeon-Si ( * ) Notice: Subject to any disclaimer, the term of this patent is extended or adjusted under 35 U.S.C. 154(b) by 147 days.

(21) Appl. No.: 14/696,491

(22) Filed: Apr. 27, 2015

(65) Prior Publication Data

US 2015/0224561 A1 Aug. 13, 2015

Related U.S. Application Data

(62) Division of application No. 13/152,184, filed on Jun. 2, 2011, now Pat. No. 9,091,487.

(30) Foreign Application Priority Data

Aug. 18, 2010 (KR) ..... 10-2010-0079940

(51) Int. Cl.

| | |
|---|---|
| ***B21D 53/06*** | (2006.01) |
| ***F28D 7/10*** | (2006.01) |
| ***F28D 7/14*** | (2006.01) |
| ***F28F 1/42*** | (2006.01) |

(52) U.S. Cl.

CPC ..... *B21D 53/06* (2013.01); *F28D 7/106* (2013.01); *F28D 7/14* (2013.01); *F28F 1/426* (2013.01); *F28F 2001/428* (2013.01); *F28F 2210/06* (2013.01); *F28F 2265/28* (2013.01); *Y10T 29/49361* (2015.01); *Y10T 29/49377* (2015.01); *Y10T 29/49391* (2015.01)

(58) Field of Classification Search

CPC . B21D 53/06; F28D 7/14; F28D 7/106; F28F 1/426; F28F 2265/28; F28F 2001/428; F28F 2210/06; Y10T 29/49377; Y10T 29/49391

See application file for complete search history.

(56) References Cited

U.S. PATENT DOCUMENTS 3,104,735 A 9/1963 Ludlow et al.
3,259,206 A * 7/1966 Straw ..... F01N 1/026 138/44

(Continued)

*Primary Examiner* — Ryan J Walters
*Assistant Examiner* — Lawrence Averick
(74) *Attorney, Agent, or Firm* — Patent Law Group LLP; David C. Hsia

(57) ABSTRACT

A double pipe type heat exchanger includes an inner pipe having a first flow path defined therein and an outer pipe arranged around the inner pipe to define a second flow path between the inner pipe and the outer pipe. The inner pipe includes a spiral groove formed on an outer circumferential surface of the inner pipe to extend along a longitudinal direction of the inner pipe. The outer pipe includes a reduced diameter portion protruding inwardly so that the inner surface of the outer pipe is intermittently contacted with the outer circumferential surface of the inner pipe.

4 Claims, 8 Drawing Sheets

(56) References Cited

U.S. PATENT DOCUMENTS

| | | | | |
|---|---|---|---|---|
| 3,730,229 | A * | 5/1973 | D'Onofrio | B21D 11/14 138/114 |
| 3,864,937 | A | 2/1975 | Asher et al. | |
| 4,086,959 | A * | 5/1978 | Habdas | F28F 1/42 165/141 |
| 4,878,537 | A * | 11/1989 | Verkaart | A61M 5/44 165/156 |
| 6,220,344 | B1 * | 4/2001 | Beykirch | F28D 7/022 165/154 |
| 7,866,378 | B2 | 1/2011 | Nakamura et al. | |
| 7,886,420 | B2 * | 2/2011 | Naganawa | B21C 37/151 29/507 |
| 2004/0007350 | A1 * | 1/2004 | Wu | B01J 19/0013 165/156 |
| 2006/0096314 | A1 * | 5/2006 | Nakamura | F16L 7/00 62/498 |
| 2011/0036544 | A1 * | 2/2011 | Shirai | E03D 9/08 165/95 |
| 2012/0043055 | A1 | 2/2012 | Byon et al. | |
| 2013/0025834 | A1 * | 1/2013 | Choi | F28F 1/40 165/156 |
| 2014/0109373 | A1 * | 4/2014 | Nakamura | F16L 7/00 29/428 |

* cited by examiner

DOUBLE PIPE TYPE HEAT EXCHANGER AND METHOD FOR MANUFACTURING THE SAME

CROSS-REFERENCE TO RELATED APPLICATIONS

This application is a divisional of U.S. patent application Ser. No. 13/152,184, filed Jun. 2, 2011, which claims priority to KR application 10-2010-0079940 filed Aug. 18, 2010. Both U.S. Ser. No. 13/152,184 and KR 10-2010-0079940 are incorporated herein by reference.

FIELD OF THE INVENTION

The present invention relates to a double pipe type heat exchanger and a method for manufacturing the same and, more particularly, to a double pipe type heat exchanger capable of increasing the efficiency of heat exchange between fluids and capable of preventing frictional contact between an inner pipe and an outer pipe and occurrence of contact noises and contact wear and a method of manufacturing the same.

BACKGROUND OF THE INVENTION

An air-conditioning system for motor vehicles is provided with various kinds of heat exchangers, e.g., a double pipe type heat exchanger. As shown in FIGS. 1 and 2, a conventional double pipe type heat exchanger includes an inner pipe 10 and an outer pipe 20. The inner pipe 10 is provided with a first flow path 12 through which a first fluid flows. The outer pipe 20 is arranged outside the inner pipe 10 so that a second flow path 30 can be defined between the outer circumferential surface of the inner pipe 10 and the inner circumferential surface of the outer pipe 20.

A second fluid flows through the second flow path 30 between the inner pipe 10 and the outer pipe 20. The second fluid flowing through the second flow path 30 differs in temperature from the first fluid flowing through the first flow path 12. Accordingly, a heat exchange action occurs between the first fluid and the second fluid when the second fluid makes contact with the first fluid.

With the double pipe type heat exchanger mentioned above, the first fluid and the second fluid differing in temperature from each other are respectively introduced into the first flow path 12 and the second flow path 30 and brought into indirect contact with each other. This enables a heat exchange action to occur between the first fluid flowing through the first flow path 12 and the second fluid flowing through the second flow path 30.

However, the conventional double pipe type heat exchanger has a drawback in that a gap G is generated between the inner pipe 10 and the outer pipe 20 due to the assembling tolerance. This may reduce the heat exchange efficiency and may cause the inner pipe 10 and the outer pipe 20 to make frictional contact with each other.

In other words, with a view to assure smooth assembling of the inner pipe 10 and the outer pipe 20, the double pipe type heat exchanger is designed such that the inner diameter L1 of the outer pipe 20 is greater than the outer diameter L2 of the inner pipe 10. Thus, an assembling tolerance exists between the inner pipe 10 and the outer pipe 20.

The assembling tolerance may become a cause of generating a gap G between the inner pipe 10 and the outer pipe 20. The existence of this gap G poses a problem in that the second fluid introduced into the second flow path flows along a straight line. This tends to sharply reduce the heat exchange time between the first fluid flowing through the first flow path 12 and the second fluid flowing through the second flow path 30. The reduction of the heat exchange time between the first fluid and the second fluid leads to a remarkable reduction of the heat exchange efficiency, which in turn significantly reduce the performance of the heat exchanger.

Another problem of the conventional double pipe type heat exchanger resides in that the gas G existing between the inner pipe 10 and the outer pipe 20 allows the inner pipe 10 to move within the outer pipe 20. Thus, the inner pipe 10 is likely to make contact with the inner circumferential surface of the outer pipe 20.

In particular, if the vibration of a motor vehicle is transferred to the inner pipe 10, the inner pipe 10 vibrates at a high speed. This causes the inner pipe 10 and the outer pipe 20 to make frictional contact with each other. As a result, contact noises may be generated between the inner pipe 10 and the outer pipe 20, and the contact portions of the inner pipe 10 and the outer pipe 20 may be worn. The contact wear of the inner pipe 10 and the outer pipe 20 may significantly reduce the durability of the heat exchanger, thereby shortening the lifespan of the heat exchanger.

SUMMARY OF THE INVENTION

In view of the above-noted problems, it is an object of the present invention to provide a double pipe type heat exchanger capable of allowing a fluid to spirally flow along a flow path between an inner pipe and an outer pipe, and a method for manufacturing the same.

Another object of the present invention is to provide a double pipe type heat exchanger capable of increasing the time of heat exchange between a fluid flowing along a first flow path defined within an inner pipe and a fluid flowing along a second flow path defined between an inner pipe and an outer pipe, and a method for manufacturing the same.

A further object of the present invention is to provide a double pipe type heat exchanger capable of maximizing the efficiency of heat exchange between a fluid flowing along a first flow path defined within an inner pipe and a fluid flowing along a second flow path defined between an inner pipe and an outer pipe, and a method for manufacturing the same.

A still further object of the present invention is to provide a double pipe type heat exchanger capable of preventing an inner pipe and an outer pipe from making frictional contact with each other, and a method for manufacturing the same.

A yet still further object of the present invention is to provide a double pipe type heat exchanger capable of preventing generation of contact noises and contact wear in an inner pipe and an outer pipe, and a method for manufacturing the same.

An even yet still further object of the present invention is to provide a double pipe type heat exchanger capable of enjoying enhanced durability and extended lifespan, and a method for manufacturing the same.

In one aspect of the present invention, there is provided a double pipe type heat exchanger, including:

an inner pipe having a first flow path defined therein; and an outer pipe arranged around the inner pipe to define a second flow path between the inner pipe and the outer pipe, wherein the inner pipe includes a spiral groove formed on an outer circumferential surface of the inner pipe to extend along a longitudinal direction of the inner pipe, the outer pipe including a reduced diameter portion protruding inwardly so that the inner surface of the outer pipe is intermittently contacted with the outer circumferential surface of the inner pipe.

In another aspect of the present invention, there is provided a double pipe type heat exchanger, including:

an inner pipe having a first flow path defined therein; and an outer pipe arranged around the inner pipe to define a second flow path between the inner pipe and the outer pipe, the second flow path including a longitudinally-extending gap existing between the inner pipe and the outer pipe and a spiral groove formed on an outer circumferential surface of the inner pipe, the outer pipe including a flow direction changing member for changing a flow direction of a fluid flowing along the second flow path.

In a further aspect of the present invention, there is provided a method for manufacturing a double pipe type heat exchanger including an inner pipe having a first flow path defined therein and an outer pipe arranged around the inner pipe to define a second flow path between the inner pipe and the outer pipe, comprising the steps of:

a) forming a spiral groove on an outer circumferential surface of the inner pipe and forming a pair of enlarged pipe portions in opposite end portions of the outer pipe;

b) inserting the inner pipe into the outer pipe;

c) fixing both ends of the inner pipe and the outer pipe together; and d) deforming the outer pipe to form a reduced diameter portion protruding toward the outer circumferential surface of the inner pipe.

According to the double pipe type heat exchanger of the present invention and the method of manufacturing the same, the gap existing between the inner pipe and the outer pipe is intermittently blocked so that the second fluid introduced into the second flow path can spirally flow in the closed gap areas. This enables the second fluid flowing along the second flow path to efficiently exchange heat with the first fluid flowing along the first flow path.

The efficient heat exchange between the first fluid flowing along the first flow path and the second fluid flowing along the second flow path helps significantly enhance the performance of the heat exchanger.

Since the outer pipe has the reduced diameter portions for holding the inner pipe against movement, it is possible to reliably prevent the inner pipe from moving within the outer pipe. This makes it possible to prevent the inner pipe and the outer pipe from making frictional contact with each other.

By preventing the frictional contact between the inner pipe and the outer pipe, it is possible to prevent generation of contact noises and contact wear in the inner pipe and the outer pipe. This makes it possible to enhance the durability of the heat exchanger and to prolong the lifespan thereof.

BRIEF DESCRIPTION OF THE DRAWINGS

The above and other objects and features of the present invention will become apparent from the following description of preferred embodiments, given in conjunction with the accompanying drawings.

DETAILED DESCRIPTION OF THE PREFERRED EMBODIMENTS

Certain preferred embodiments of a double pipe type heat exchanger in accordance with the present invention and a method for manufacturing the same will now be described in detail with reference to the accompanying drawings. The same reference symbols as used in describing the prior art will be used to designate the same elements.

Figure 1:
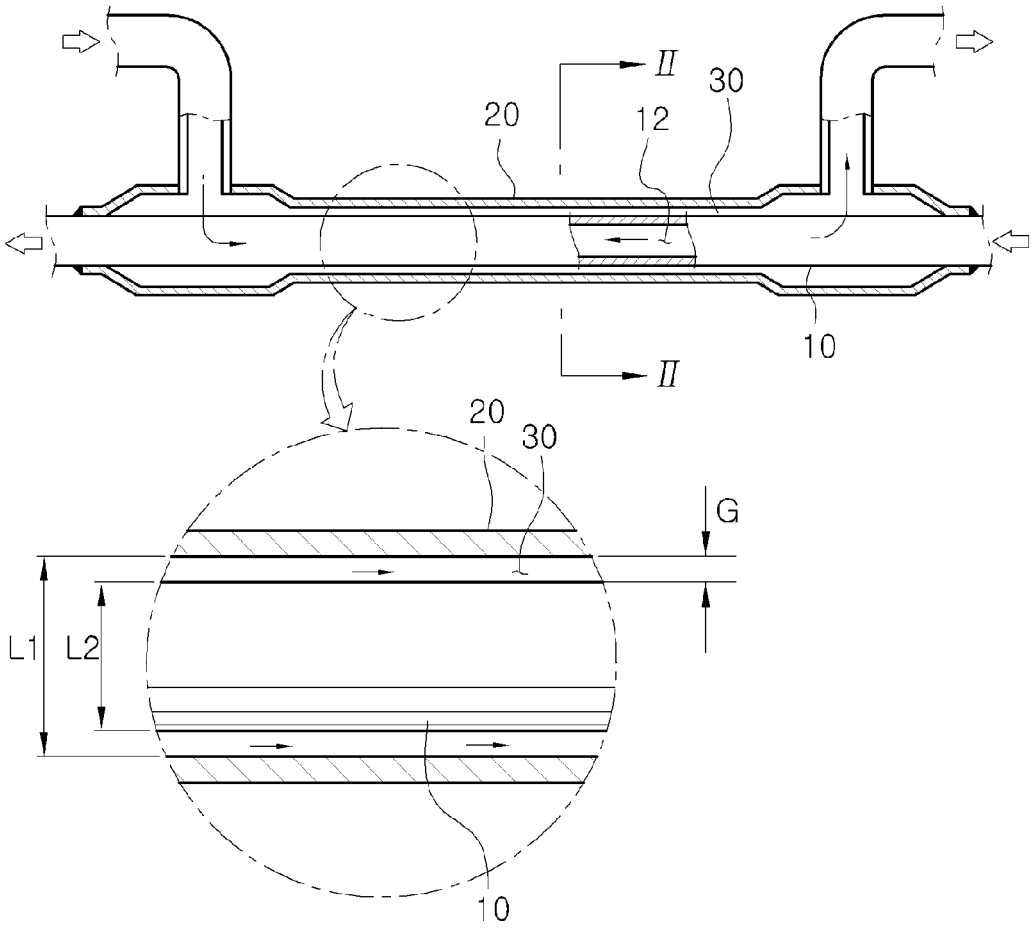
Fig. 1 (Prior Art)
FIG. 1 is a section view showing a conventional double pipe type heat exchanger.
Figure 2:
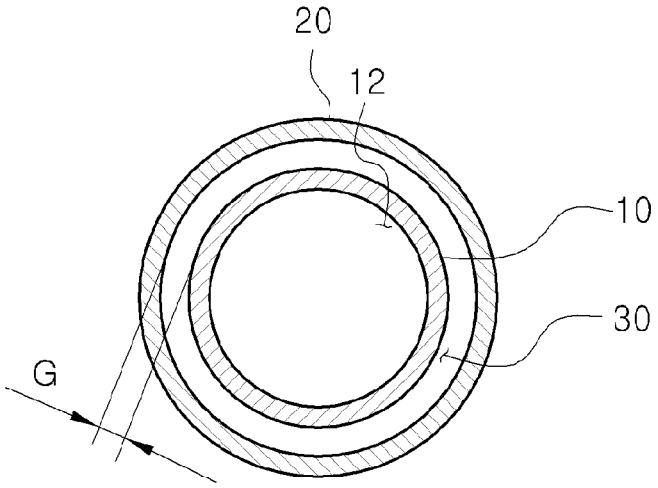
Fig. 2 (Prior Art)
FIG. 2 is a section view of the conventional double pipe type heat exchanger taken along line II-II in FIG. 1.
Figure 3A:
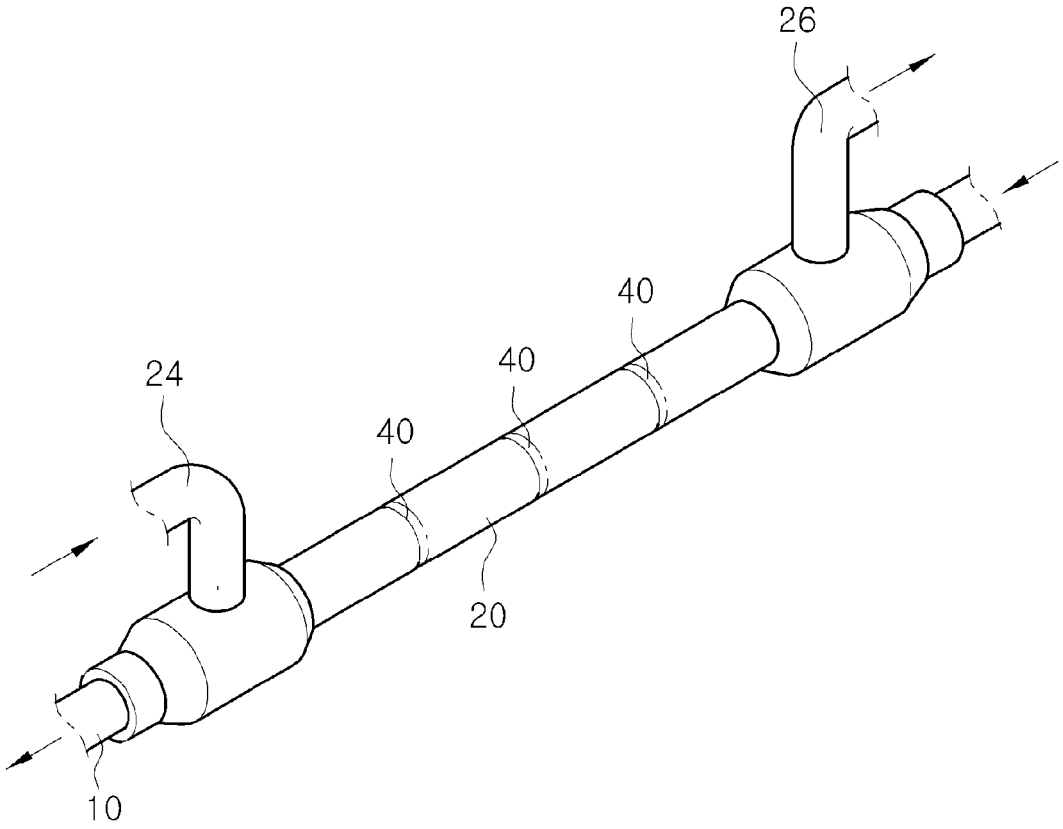
FIGS. 3A and 3B are perspective views showing a double pipe type heat exchanger in accordance with the present invention.
Figure 3B:
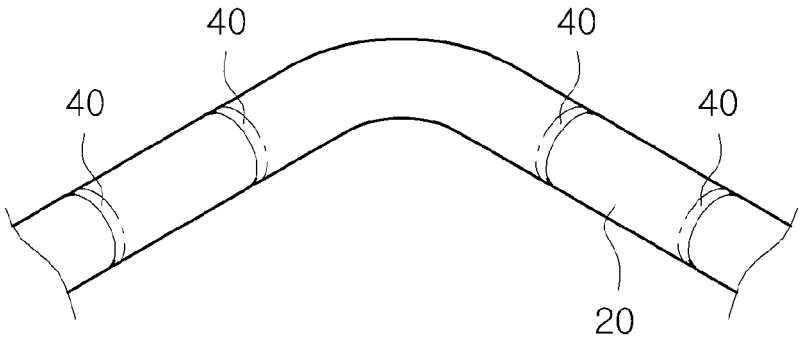
Figure 4:
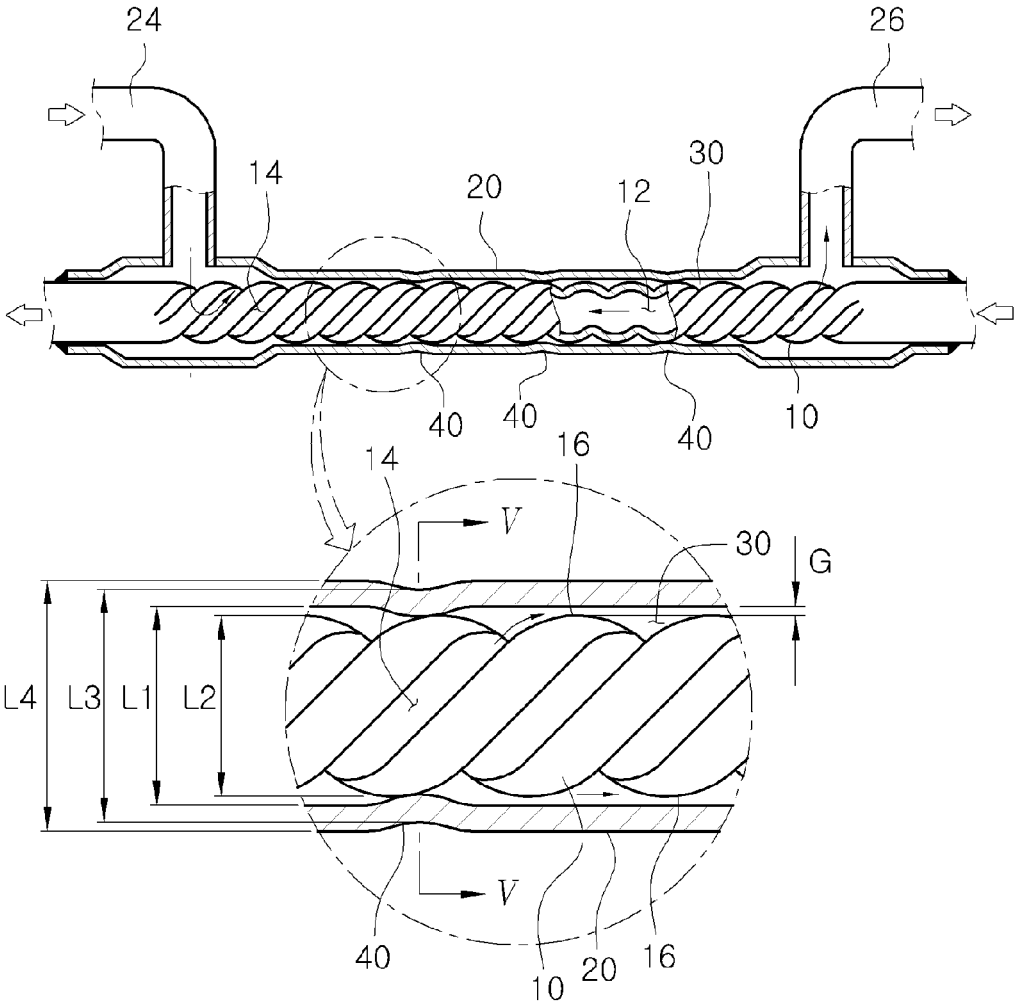
FIG. 4 is a section view showing the double pipe type heat exchanger in accordance with the present invention.
Figure 5:
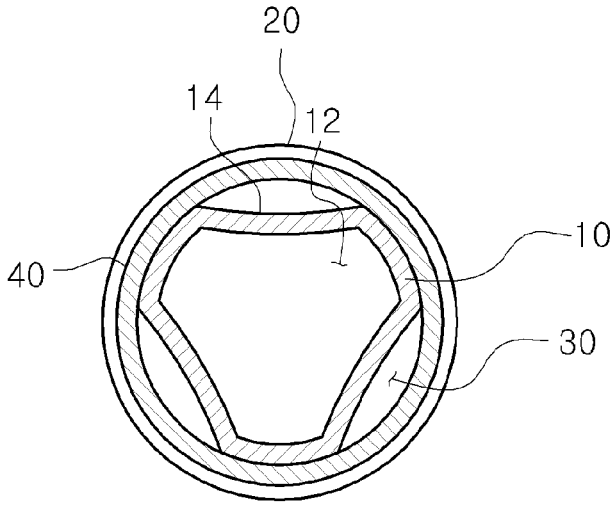
FIG. 5 is a section view of the double pipe type heat exchanger taken along line V-V in FIG. 4.

Referring to FIGS. 3 through 5, the double pipe type heat exchanger in accordance with the present invention includes an inner pipe 10 and an outer pipe 20 arranged to surround the inner pipe 10. The inner pipe 10 is provided with a first flow path 12 defined therein. A first fluid flows along the first flow path 12.

Spiral grooves 14 are formed on the outer circumferential surface of the inner pipe 10. The spiral grooves 14 extend spirally along the outer circumferential surface of the inner pipe 10. The spiral grooves 14 are formed by, e.g., pressing the outer circumferential surface of the inner pipe 10 with a rolling tool (not shown).

The outer pipe 20 is arranged around the inner pipe 10 so that a second flow path 30 can be defined between the inner pipe 10 and the outer pipe 20. In particular, the second flow path 30 is formed into a spiral shape due to the existence of the spiral grooves 14.

In general, the inner diameter L1 of the outer pipe 20 is set greater than the outer diameter L2 of the inner pipe 10. This is to set to an assembling tolerance and to generate a longitudinally-extending gap G between the inner pipe 10 and the outer pipe 20. The existence of the gap G between the inner pipe 10 and the outer pipe 20 makes it possible to smoothly assemble the inner pipe 10 and the outer pipe 20 together.

A second fluid flows along the spiral second flow path 30 defined between the inner pipe 10 and the outer pipe 20. The second fluid flowing along the spiral second flow path 30 differs in temperature from the first fluid flowing along the first flow path 12. Accordingly, a heat exchange action occurs between the first fluid and the second fluid when they flow through the first flow path 12 and the second flow path 30.

Figure 6:
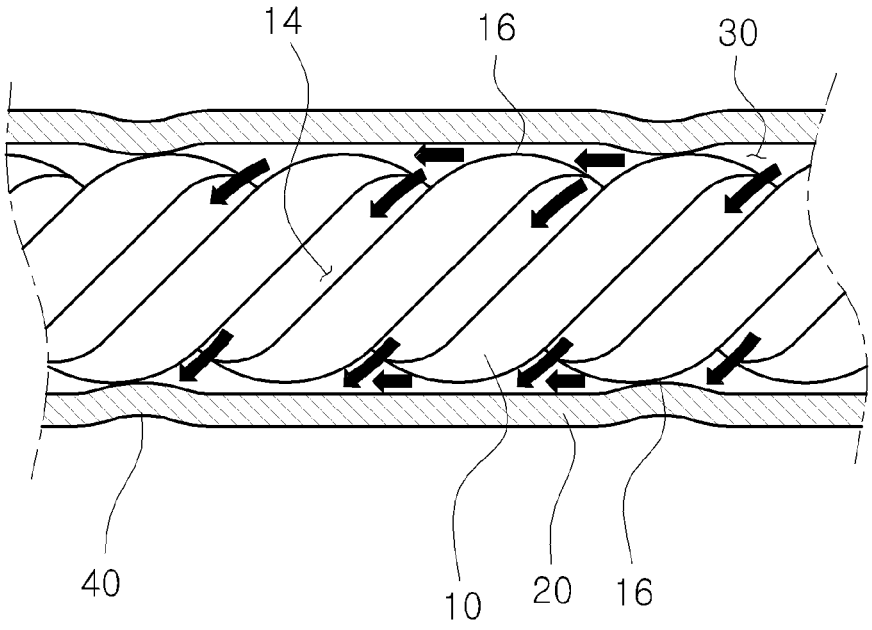
FIG. 6 is an enlarged section view showing major portions of the double pipe type heat exchanger in accordance with the present invention.

Next, the double pipe type heat exchanger of the present invention will be described in more detail with reference to FIGS. 3A, 3B and 6.

In the double pipe type heat exchanger of the present invention, the outer pipe 20 includes one or more reduced diameter portions 40 that serve as a flow direction changing means for changing the flow direction of the second fluid flowing along the second flow path 30. The reduced diameter portions 40 have a diameter L3 smaller than the diameter L4 of the remaining portions of the outer pipe 20. The reduced diameter portions 40 are formed in the portion of the outer pipe 20 extending between an inlet pipe 24 and an outlet pipe 26 and are arranged in a spaced-apart relationship along the longitudinal direction of the outer pipe 20. In this regard, the inlet pipe 24 is connected to one end of the outer pipe 20 so that the second fluid can be introduced into the second flow path 30 through the inlet pipe 24. The outlet pipe 26 is connected to the other end of the outer pipe 20 so that the second fluid can be discharged from the second flow path 30 through the outlet pipe 26.

The reduced diameter portions 40 of the outer pipe 20 protrude radially inwards and come into contact with the outer circumferential surface of the inner pipe 10. In particular, the reduced diameter portions 40 are configured to make contact with spiral ridge portions 16 of the inner pipe 10 formed between the spiral grooves 14.

By making contact with the outer circumferential surface of the inner pipe 10, the reduced diameter portions 40 at least intermittently blocks the gap G existing between the inner pipe 10 and the outer pipe 20 with the spiral grooves 14 kept opened. Thus, the second fluid flowing straightforward along the gap G is baffled by the reduced diameter portions 40 so that it can flow spirally along the spiral grooves 14.

As a result, it is possible to increase the time of heat exchange between the first fluid flowing along the first flow path 12 and the second fluid flowing along the second flow path 30. This helps maximize the efficiency of heat exchange between the first fluid and the second fluid.

Since the reduced diameter portions 40 remains in contact with the outer circumferential surface of the inner pipe 10, the outer pipe 20 holds the inner pipe 10 in place, thereby preventing the inner pipe 10 from moving within the outer pipe 20. This prevents occurrence of frictional contact between the inner pipe 10 and the outer pipe 20 otherwise caused by the movement of the inner pipe 10 with respect to the outer pipe 20. As a result, it is possible to prevent generation of contact noises and contact wear in the inner pipe 10 and the outer pipe 20. This assists in enhancing the durability of the heat exchanger and prolonging the lifespan thereof.

It is preferred that the reduced diameter portions 40 be formed along the longitudinal direction of the outer pipe 20 at relatively small intervals. This is to restrain the second fluid from flowing straightforward through the gap G and to cause the second fluid to spirally flow along the spiral grooves 14. As a consequence, the second fluid spirally flowing along the second flow path 30 can efficiently exchange heat with the first fluid flowing through the first flow path 12.

The outer pipe 20 is composed of a straight pipe portion as shown in FIG. 3A. Alternatively, the outer pipe 20 may be composed of a bent pipe portion and a plurality of straight pipe portions as shown in FIG. 3B. It is preferred that the reduced diameter portions 40 be formed in the straight portion of the outer pipe 20. This is because the inner pipe 10 and the outer pipe 20 are kept in contact with each other in the bending portions thereof.

It is preferred that the reduced diameter portions 40 be formed by a rolling work in which the outer circumferential surface of the outer pipe 20 is pressed with a forming roller to form the reduced diameter portions 40.

If necessary, the reduced diameter portions 40 may be formed by a press work in which the outer circumferential surface of the outer pipe 20 is pressed with a press mold to form the reduced diameter portions 40.

Preferably, the reduced diameter portions 40 are formed by the rolling work rather than the press work. The reason is that, if the reduced diameter portions 40 are formed by the press work, they may be restored to the original position by the elasticity of the outer pipe 20. In the event that the reduced diameter portions 40 are restored to the original position, they are spaced apart from the outer circumferential surface of the inner pipe 10. Thus, the reduced diameter portions 40 fail to close the gap G existing between the inner pipe 10 and the outer pipe 20.

One example of the operation of the double pipe type heat exchanger configured as above will be described with reference to FIGS. 4 and 6.

In a state that the inner pipe 10 is fitted into the outer pipe 20 to make contact with the reduced diameter portions 40, the first fluid is introduced into the first flow path 12 of the inner pipe 10 and the second fluid is introduced into the second flow path 30 defined between the inner pipe 10 and the outer pipe 20. The first fluid flowing along the first flow path 12 makes indirect contact with the second fluid flowing along the second flow path 30 such that heat exchange occurs between the first fluid and the second fluid.

In the areas of the second flow path 30 where the reduced diameter portions 40 do not exist, the second fluid flows straightforward along the gap G between the inner pipe 10 and the outer pipe 20 and also flows spirally along the spiral grooves 14 formed on the inner pipe 10. While flowing both straightforward and spirally along the second flow path 30, the second fluid exchanges heat with the first fluid flowing along the first flow path 12.

In the areas of the second flow path 30 where the gap G is closed by the reduced diameter portions 40, the second fluid flows spirally along the spiral grooves 14 formed on the inner pipe 10. Thus, the second fluid flowing long way along the spiral grooves 14 can efficiently exchange heat with the first fluid flowing along the first flow path 12.

In this manner, the second fluid repeats the straight and spiral flow and the spiral flow as it passes through the second flow path 30. This enhances the efficiency of heat exchange between the first fluid and the second fluid, thereby significantly improving the performance of the heat exchange.

With the double pipe type heat exchanger configured as above, the gap G existing between the inner pipe 10 and the outer pipe 20 is intermittently blocked so that the second fluid introduced into the second flow path 30 can spirally flow in the closed gap areas. This enables the second fluid flowing along the second flow path 30 to efficiently exchange heat with the first fluid flowing along the first flow path 12.

The efficient heat exchange between the first fluid flowing along the first flow path 12 and the second fluid flowing along the second flow path 30 helps significantly enhance the performance of the heat exchanger.

Since the outer pipe 20 has the reduced diameter portions 40 for holding the inner pipe 10 against movement, it is possible to reliably prevent the inner pipe 10 from moving within the outer pipe 20. This makes it possible to prevent the inner pipe 10 and the outer pipe 20 from making frictional contact with each other.

By preventing the frictional contact between the inner pipe 10 and the outer pipe 20, it is possible to prevent generation of contact noises and contact wear in the inner pipe 10 and the outer pipe 20. This makes it possible to enhance the durability of the heat exchanger and to prolong the lifespan thereof.

Next, a method for manufacturing the double pipe type heat exchanger will be described in detail with reference to FIGS. 7, 8A through 8B.

Figure 7:
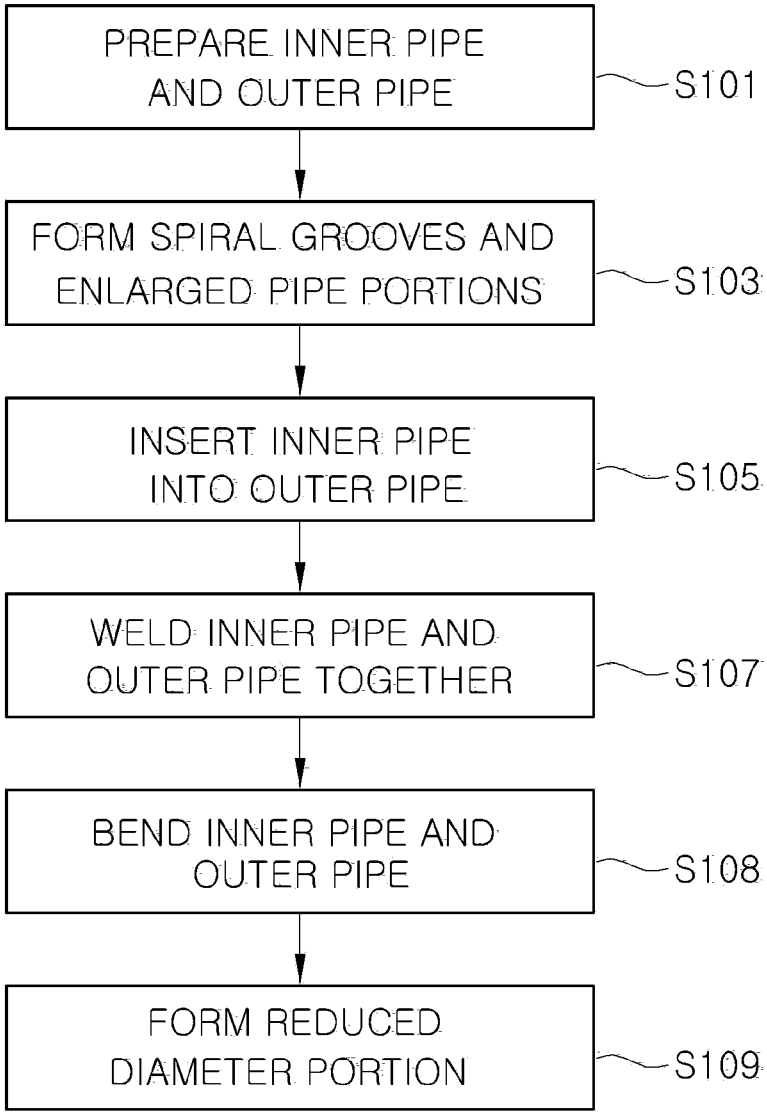
FIG. 7 is a flowchart illustrating a method for manufacturing a double pipe type heat exchanger in accordance with the present invention.
Figure 8A:
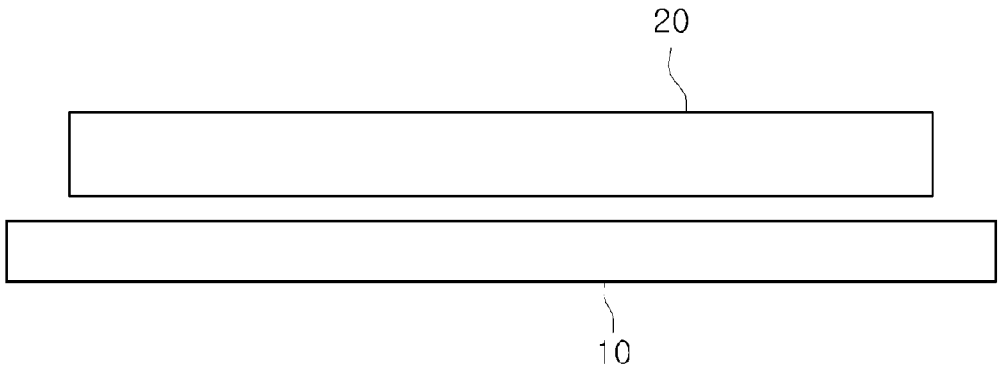
FIGS. 8A through 8F are views showing the shape and arrangement of an inner pipe and an outer pipe in the respective steps of the method for manufacturing the double pipe type heat exchanger.
Figure 8B:
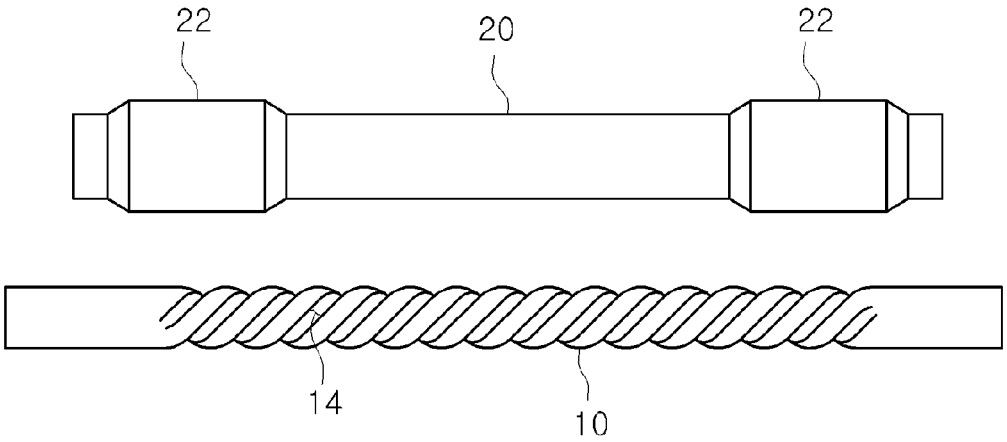

As shown in FIG. 8A, an inner pipe 10 and an outer pipe 20 are prepared first (S101 in FIG. 7). Then, as shown in FIG. 8B, spiral grooves 14 are formed on the outer circumferential surface of the inner pipe 10 and enlarged pipe portions 22 are formed in the opposite end portions of the outer pipe 20 (S103 in FIG. 7). The spiral grooves 14 are formed by, e.g., a rolling work in which the outer circumferential surface of the inner pipe 10 is pressed with a forming roller. The enlarged pipe portions 22 are formed by, e.g., a pipe-enlarging press work in which opposite end portions of the outer pipe 20 are enlarged with a press machine.

Figure 8C:
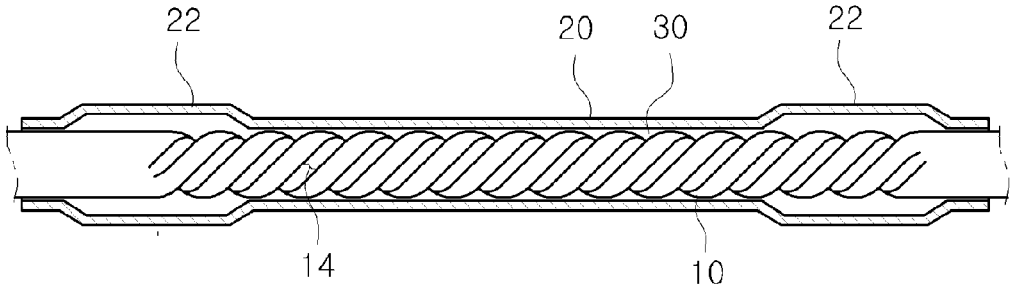
Figure 8D:
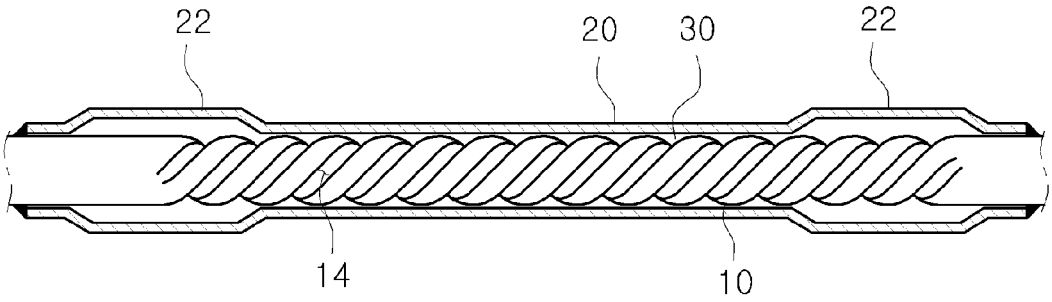

Upon finishing formation of the spiral grooves 14 and the enlarged pipe portions 22, the inner pipe 10 is inserted into the outer pipe 20 as shown in FIG. 8C (S105 in FIG. 7). Subsequently, the inner pipe 10 and the outer pipe 20 are welded together at their opposite ends as shown in FIG. 8C (S107 in FIG. 7).

Figure 8E:
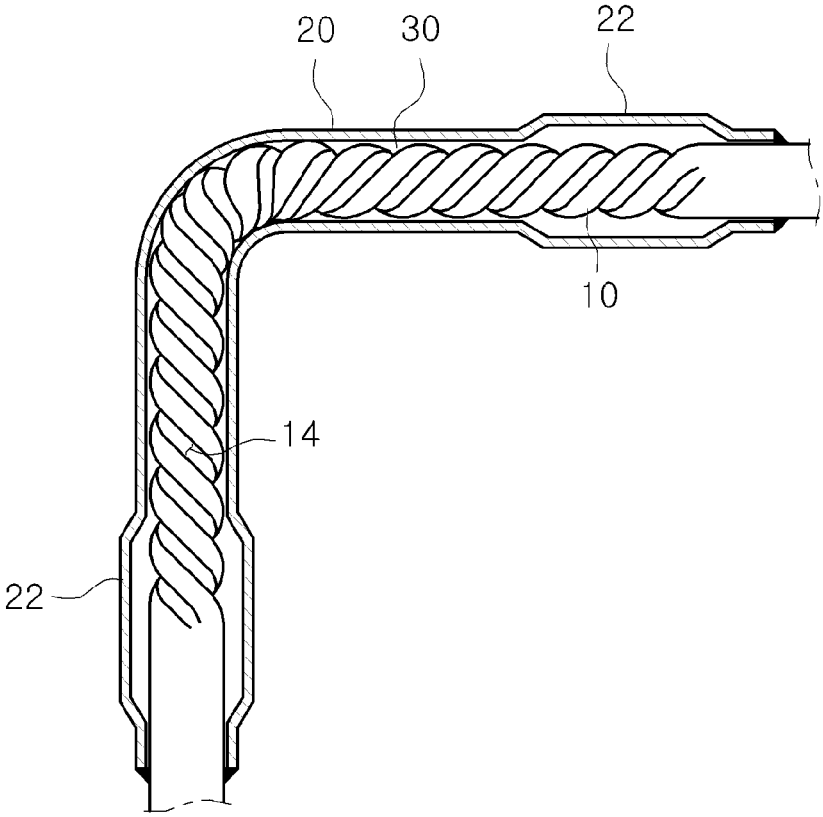

Thereafter, the inner pipe 10 and the outer pipe 20 are bent into a desired shape as shown in FIG. 8E (S108 in FIG. 7). As a result, the inner pipe 10 and the outer pipe 20 come into contact with each other in the bent portions thereof.

Figure 8F:
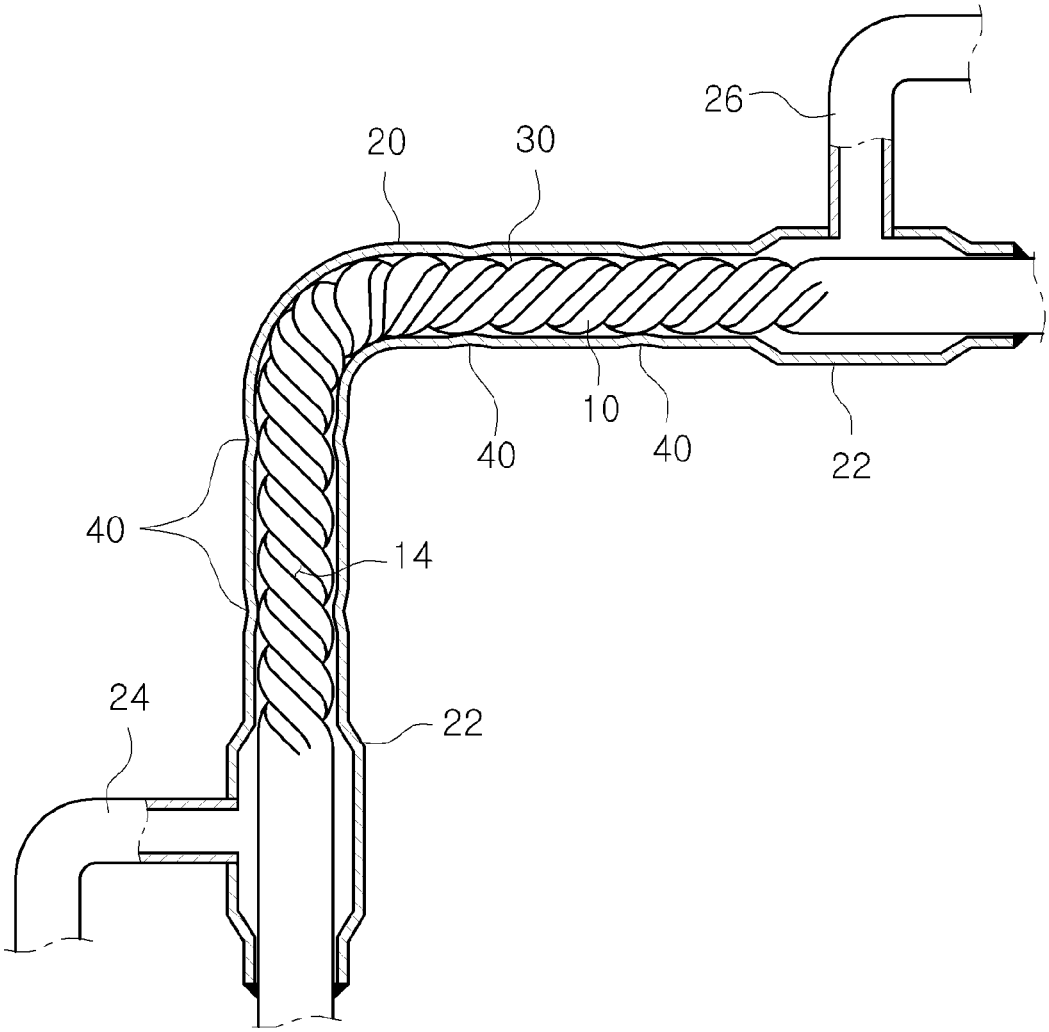

Then, as shown in FIG. 8F, a plurality of reduced diameter portions 40 is formed in the outer pipe 20 at a desired interval (S109 in FIG. 7) by deforming the outer pipe 20. The reduced diameter portions 40 is formed by, e.g., a rolling work in which the outer circumferential surface of the outer pipe 20 is pressed with a forming roller. If necessary, an inlet pipe 24 and an outlet pipe for introducing and discharging a second fluid therethrough are fitted to the enlarged pipe portions 22 of the outer pipe 20.

The double pipe type heat exchanger manufactured through the afore-mentioned steps has a first flow path 12 through which a first fluid can flow, a second flow path 30 through which a second fluid can flow and a plurality of reduced diameter portions 40 arranged along the outer pipe 20 at a specified interval.

The reduced diameter portions 40 of the outer pipe 20 protrude radially inwards to make contact with the outer circumferential surface of the inner pipe 10. Thus, the gap G existing between the inner pipe 10 and the outer pipe 20 is at least intermittently blocked by the reduced diameter portions 40. The inner pipe 10 is held against movement by the reduced diameter portions 40 of the outer pipe 20.

While certain preferred embodiments of the invention have been described hereinabove, the present invention is not limited to these embodiments. It is to be understood that various changes and modifications may be made without departing from the scope of the invention defined in the claims.

What is claimed is:

1. A method for manufacturing a double pipe type heat exchanger including an inner pipe having a first flow path defined therein and an outer pipe arranged around the inner pipe to define a second flow path between the inner pipe and the outer pipe, comprising the steps of:

a) forming a spiral groove on an outer circumferential surface of the inner pipe and forming a pair of enlarged pipe portions in opposite end portions of the outer pipe;

b) inserting the inner pipe into the outer pipe;

c) fixing both ends of the inner pipe and the outer pipe together; and d) deforming a straight pipe portion of the outer pipe to form circumferential reduced diameter portions around a straight pipe portion of the inner pipe, the circumferential reduced diameter portions protruding toward the outer circumferential surface of the inner pipe, and wherein, in step d), the circumferential reduced diameter portions of the outer pipe are configured along circumferential direction of the spiral groove of the inner pipe to intermittently block a longitudinal gap between a spiral ridge of the inner pipe and an inner surface of the outer pipe such that a fluid flows spirally only along the spiral groove of the inner pipe at the circumferential reduced diameter portions.

2. The method as recited in claim 1, further comprising the step of:

after step c) and before step d), bending the outer pipe together with the inner pipe such that a bent pipe portion is formed in the outer pipe and a bent pipe portion is formed in the inner pipe.

3. The method as recited in claim 2, wherein, in step d), the circumferential reduced diameter portions are formed in multiple numbers along the straight pipe portion of the outer pipe.

4. The method as recited in claim 1, further comprising the step of:

after step d), fitting an inlet pipe and an outlet pipe for introducing and discharging the fluid to the enlarged pipe portion of the outer pipe.

* * * * *